US009089729B2

(12) United States Patent
Almeida et al.

(10) Patent No.: US 9,089,729 B2
(45) Date of Patent: Jul. 28, 2015

(54) FIRE PROTECTION DEVICE

(71) Applicant: Tyco Fire Products LP, Lansdale, PA (US)

(72) Inventors: Jose L. Almeida, Warwick, RI (US); Marcelo J. Chavez, Providence, RI (US)

(73) Assignee: Tyco Fire Products LP, Lansdale, PA (US)

( * ) Notice: Subject to any disclaimer, the term of this patent is extended or adjusted under 35 U.S.C. 154(b) by 0 days.

(21) Appl. No.: 14/248,185

(22) Filed: Apr. 8, 2014

(65) Prior Publication Data

US 2014/0216769 A1 Aug. 7, 2014

Related U.S. Application Data

(63) Continuation of application No. PCT/US2013/020233, filed on Jan. 4, 2013.

(60) Provisional application No. 61/584,641, filed on Jan. 9, 2012.

(51) Int. Cl.

| | |
|---|---|
| ***A62C 37/08*** | (2006.01) |
| ***B05B 1/26*** | (2006.01) |
| ***A62C 35/68*** | (2006.01) |
| ***A62C 37/11*** | (2006.01) |
| *A62C 3/02* | (2006.01) |

(52) U.S. Cl.

CPC ..... *A62C 35/68* (2013.01); *A62C 37/11* (2013.01); *B05B 1/265* (2013.01); *B05B 1/267* (2013.01); *A62C 3/0221* (2013.01)

(58) Field of Classification Search

USPC ..... 169/37; 239/495–498, 506, DIG. 1, 502, 239/522, 504

See application file for complete search history.

(56) References Cited

U.S. PATENT DOCUMENTS

| | | | |
|---|---|---|---|
| 2,046,169 | A | 6/1936 | Knight |
| 2,101,694 | A | 12/1937 | Tyden |
| 3,880,239 | A | 4/1975 | Vorkapich |

(Continued)

FOREIGN PATENT DOCUMENTS

| | | | |
|---|---|---|---|
| GB | 2 337 199 | A | 11/1999 |

OTHER PUBLICATIONS

Globe Fire Sprinkler Corp., Datasheet, Residential Automatic Sprinklers Model GL4231, Hor. Sidewall Recessed Hor. Sidewall, Rev. #2, Oct. 2005, 2 pp.

(Continued)

*Primary Examiner* — Len Tran
*Assistant Examiner* — Alexander Valvis
(74) *Attorney, Agent, or Firm* — Perkins Coie LLP

(57) ABSTRACT

A fire protection device including a frame having a body with an inlet and an outlet disposed spaced along a longitudinal axis of a passageway. A pair of arms is disposed in a first plane parallel to the longitudinal axis and coupled to the body. A deflector assembly having a generally planar face portion is distally spaced from the outlet of the body and orthogonal to the longitudinal axis. The face portion includes two openings on opposite sides of a second plane perpendicular to the first plane. A canopy portion is supported on a first side of the first plane from the face portion. The deflector assembly includes a plurality of tines extending along the face portion on a second side of the first plane. Each of the tines have an outer edge disposed on a common circle centered along the longitudinal axis.

32 Claims, 6 Drawing Sheets

(56) References Cited

U.S. PATENT DOCUMENTS

| | | | | |
|---|---|---|---|---|
| 4,014,388 | A | 3/1977 | Anderson | |
| 4,296,815 | A | 10/1981 | Mears | |
| 4,296,816 | A * | 10/1981 | Fischer | 169/37 |
| 4,585,069 | A | 4/1986 | Whitaker | |
| H000121 | H | 9/1986 | Pieczykolan | |
| 4,987,957 | A | 1/1991 | Galaszewski | |
| 5,669,449 | A | 9/1997 | Polan et al. | |
| 5,722,599 | A | 3/1998 | Fries | |
| 5,727,737 | A | 3/1998 | Bosio et al. | |
| 5,810,263 | A | 9/1998 | Tramm | |
| 6,098,718 | A | 8/2000 | Sato | |
| 6,367,559 | B1 | 4/2002 | Winebrenner | |
| 6,374,919 | B1 | 4/2002 | Neill | |
| 6,520,265 | B2 | 2/2003 | Winebrenner | |
| 6,799,639 | B2 | 10/2004 | Sato et al. | |
| 6,889,774 | B2 | 5/2005 | Multer et al. | |
| 6,920,937 | B2 | 7/2005 | Neill et al. | |
| 7,137,455 | B2 | 11/2006 | Green | |
| 7,165,624 | B1 * | 1/2007 | Fischer | 169/37 |
| 7,353,882 | B2 | 4/2008 | Pahila | |
| 7,614,457 | B2 | 11/2009 | Green | |
| 7,712,218 | B2 | 5/2010 | Franson | |
| 7,712,543 | B2 * | 5/2010 | Golinveaux | 169/46 |
| 7,784,555 | B2 | 8/2010 | Pahila | |
| 7,841,418 | B2 | 11/2010 | Pahila et al. | |
| 7,921,928 | B2 | 4/2011 | Thompson et al. | |
| 8,151,897 | B1 | 4/2012 | Meyer et al. | |
| 8,387,711 | B2 | 3/2013 | Cordell et al. | |
| 2010/0078181 | A1 | 4/2010 | Fischer et al. | |

OTHER PUBLICATIONS

Globe Fire Sprinkler Corp., Datasheet, Quick Response Extended Cov. Automatic Spr, Models GL8128, GL8129, Hor. Sidewall, Rev. #5, Oct. 2003, 2 pp.

Globe Fire Sprinkler Corp., Datasheet, Quick Response Concealed Extended Cov. Hor. Sidewall for Light Hazard Occup., Model GL8114, Rev. #1, Feb. 2005, 2 pp.

Globe Fire Sprinkler Corp., Datasheet, Quick Response Concealed Extended Cov. Hor. Sidewall for Light Hazard Occupancies, Bulletin GL5613, Rev. #7, Feb. 2005, 2 pp.

Globe Fire Sprinkler Corp., Datasheet, Extended Cov. Automatic Spr. Models GL8128, GL8129, GL8174 Hor. Sidewall, Rev. #5, Oct. 2003, 2 pp.

Globe Fire Sprinkler Corp., Datasheet, Quick Response Extended Coverage Automatic Sprinklers Model GL5628, Hor. Sidewall, Bulletin GL5628, Rev. #4, May 2004, 2 pp.

Globe Fire Sprinkler Corp., Datasheet, Quick Response Automatic Spr. GL Series, Dry Type Hor. Sidewall, Recessed Hor. Sidewall, Bulletin GL5641, Rev. #13, Aug. 2007, 2 pp.

Globe Fire Sprinkler Corp., Datasheet, Automatic Spr. GL Series, Dry Type Hor. Sidewall, Recessed Hor. Sidewall, Bulletin GL5685, Rev. #13, Apr. 2007, 2 pp.

Globe Fire Sprinkler Corp., Datasheet, Replacement Residential Auto. Sprinklers GL4230, GL5630, GL5631. Hor. Sidewall, Bulletin GL4230, Rev. #3, Oct. 2003, 2 pp.

Globe Fire Sprinkler Corp., Datasheet, Replacement Residential Auto. Sprinklers GL4234 Low Flow Hor. Sidewall Recessed Hor. Sidewall, Bulletin GL4234, Rev. #3, Oct. 2003, 2 pp.

The Reliable Automatic Sprinkler Co., Datasheet, Model DH80, Model DH80 Recessed, DH80 Concealed Quick Resp. Ext. Cov. Spr. Bulletin 003, Rev. E. May 2008, 4 pp.

The Reliable Automatic Sprinkler Co., Datasheet, Model DH56, Model DH56 Recessed, DH56 Concealed Quick Resp. Ext. Cov. Spr. Bulletin 015, Rev. A. Apr. 2008, 4 pp.

The Reliable Automatic Sprinkler Co., Datasheet, Model DH56, Model DH56 Recessed, DH56 Concealed Quick Resp. Ext. Cov. Dry Spr. Bulletin 016, Rev. C. Apr. 2008, 6 pp.

The Reliable Automatic Sprinkler Co., Datasheet, Model G Sidewall, Model G/F1 Recessed Sidewall Sprinklers, Bulletin 112V, Dec. 2000, 4 pp.

The Reliable Automatic Sprinkler Co., Datasheet, Model MBEC-14, Ext. Coverage, Ord & Extra Hazard Hor Sidewall Spr. for Metal Blg. Applns, Bulletin 169, Rev. D, Oct. 2005, 6 pp.

Tyco Fire & Bldg Products, Datasheet, Series LFII Residential Horizontal Sidewall Spr 4.4 K-factor, TFP412, Dec. 2007, 6 pp.

Tyco Fire & Bldg Products, Datasheet, Series LFII Residential NFPA 13 Optimized Horizontal Sidewall Spr 5.6 K-factor, TFP415, Jan. 2006, 6 pp.

Tyco Fire & Bldg Products, Datasheet, Series LFII Residential NFPA 13 Optimized Horizontal Sidewall Spr 5.8 K-factor, TFP417, Feb. 2007, 6 pp.

Tyco Fire & Bldg Products, Datasheet, Series LFII Residential Flush Horizontal Sidewall Spr 4.2 K-factor, TFP425, Jan. 2006, 6 pp.

Tyco Fire & Bldg Products, Datasheet, Series EC-5 5.6 K-factor Extended Coverage Hor. Sidewall Spr., Quick and Stand. Response, TFP298, Jan. 2005, 6 pp.

Tyco Fire & Bldg Products, Datasheet, Series LFII Residential Horizontal Sidewall Spr 4.2 K-factor, TFP410, Jan. 2006, 8 pp.

Tyco Fire & Bldg Products, Datasheet, Series DS-3, 11.2 K-factor, Dry Type Sprinklers Horizontal Sidewall Extended Cov. Ord. Hazard TFP550, Dec. 2007, 8 pp.

Tyco Fire & Bldg Products, Datasheet, Model TFP PH5 5.6 K-factor Inst. Horizontal Sidewall Sprinklers Standard Resp., Standard Coverage, TFP654, Apr. 2004, 4 pp.

Tyco Fire & Bldg Products, Datasheet, Model TFP MAX 5.6 K-factor Inst. Horizontal Sidewall Sprinklers Quick Resp., Standard Coverage, TFP656, Apr. 2004, 4 pp.

Tyco Fire & Bldg Products, Datasheet, Model TY-FRL 5.6 K-factor Horizontal Sidewall Sprinklers Quick Resp., Standard Coverage, TFP140, Jul. 2004, 4 pp.

Tyco Fire & Bldg Products, Datasheet, Model TY-B 5.6 K-factor Horizontal and Vertical Sidewall Sprinklers Standard Resp., Standard Coverage, TFP161, Apr. 2006, 6 pp.

Tyco Fire & Bldg Products, Datasheet, Model TY-FRB 5.6 K-factor Horizontal and Vertical Sidewall Sprinklers Quick Resp., Standard Coverage, TFP176, Apr. 2006, 6 pp.

Tyco Fire & Bldg Products, Datasheet, Model SW-20 and SW-24 11.2 K-factor Extended Coverage Ord. Hazard Hor. Sidewall Spr. (Standard Response), TFP230, Jan. 2005, 6 pp.

Tyco Fire & Bldg Products, Datasheet, Model CHEC 8.0 K-factor Concealed Hor. Extended Coverage Quick Resp. Light Hazard, Sidewall Spr., TFP265, May 2008, 6 pp.

Tyco Fire & Bldg Products, Datasheet, Model TY-FRL 5.6 and 8.0 K-factor Extended Coverage Horizontal Sidewall Spr. Quick and Standard Response, TFP280, Jan. 2005, 6 pp.

Tyco Fire & Bldg Products, Datasheet, Model TY-FRB 5.6 and 8.0 K-factor Extended Coverage Horizontal Sidewall Spr. Quick and Standard Response, TFP296, Jan. 2007, 8 pp.

The Reliable Automatic Sprinkler Co., Model SWC Concealed Quick Response Extended Coverage Hor. Sidewall Sprinkler, Bulletin 163, Rev. F, Feb. 2008, 4 pp.

Victaulic Company, Datasheet, V27, K5.6 Models V2709 and V2710 Standard Spray Hor. Sidewall and Recessed Hor . . . Response, Bulletin 40.11, Rev. F, Jan. 2008, 8 pp.

Victaulic Company, Datasheet, V34, K8.0 Models V3409 and V3410 Standard Spray Hor. Sidewall and Recessed Hor . . . Response, Bulletin 40.16, Rev. E, Apr. 2006, 8 pp.

Victaulic Company, Datasheet, V34, K8.0 Models V3415 Extended Cov./Light Hazard (ECLH) Hor. Sidewall and Recessed Hor . . . Response, Bulletin 40.33, Rev. E, Oct. 2007, 8 pp.

Victaulic Company, Datasheet, V27, K4.2 Models V2738 Residential Hor. Sidewall and Recessed Hor . . . Quick Response, Bulletin 40.54, Rev. B, 2004, 8 pp.

Victaulic Company, Datasheet, V36, K5.6 Models V3609 and V3610 Dry Type Standard Spray Hor. Sidewall and Recessed Horizontal Sidewall, Bulletin 40.64, Rev. H, 2004, 8 pp.

Victaulic Company, Datasheet, V36, K8.0 Models V3611 and V3612 Dry Type Standard Spray Hor. Sidewall and Recessed Horizontal Sidewall, Bulletin 40.65, Rev. H, 2006, 7 pp.

The Viking Corporation, Datasheet, Standard Response Ord. Hazard, Dry HSW Sprinklers, Sprinkler Bulletin 102j-102q, Jun. 6, 2008, 8 pp.

(56) References Cited

OTHER PUBLICATIONS

The Viking Corporation, Datasheet, Quick Response Ord. Hazard, Dry HSW Sprinklers, Sprinkler Bulletin 106l-106s, Jun. 6, 2008, 8 pp.
The Viking Corporation, Datasheet, Quick Response Ord. Hazard, Dry HSW Fusible Link Sprinklers, Sprinkler Bulletin 107h-107o, May 16, 2008, 8 pp.
The Viking Corporation, Datasheet, Quick Response Dry Hor. Sidewall Sprinklers, Sprinkler Bulletin 106a-106g, Jun. 6, 2008, 8 pp.
The Viking Corporation, Datasheet, Quick Response Extended Coverage Dry Hor. Sidewall Sprinklers, Sprinkler Bulletin 109a-109f, Jul. 11, 2008, 6 pp.
The Viking Corporation, Datasheet, Standard Response Dry Hor. Sidewall Sprinklers, Sprinkler Bulletin 102a-102h, Jun. 6, 2008, 8 pp.
The Viking Corporation, Datasheet, Microfast Standard/Quick Response Extended Coverage HSW Sprinkler, Sprinkler Bulletin 82a-82f, Jul. 4, 2008, 6 pp.
The Viking Corporation, Datasheet, Quick Response Extended Coverage HSW Sprinkler SIN VK630 (K8.0), Sprinkler Bulletin 80a-80e, Jul. 4, 2008, 6 pp.
The Viking Corporation, Datasheet, Quick Response Ordinary Hazard Dry HSW Sprinkler, Sprinkler Bulletin 106i-106r, Apr. 13, 2007, 8 pp.
Grinnell Corporation, Datasheet, Horizontal Sidewall Sprinklers, Model FR-1, Fast Response Solder Type 17/32" (20 mm) Orifice, TF589, Mar. 1995, 8 pp.
Grinnell Corporation, Datasheet, Horizontal Sidewall Sprinklers, Model FR-1, Fast Response Solder Type 1/2" (15 mm) Orifice, TF588, Mar. 1995, 8 pp.
Grinnell Corporation, Datasheet, Dry Horizontal Sidewall Sprinklers, Model F960/Q-48 Designer 1/2" Orifice, TF557, Nov. 1992, 6 pp.
Grinnell Corporation, Datasheet, Automatic Sprinklers Model F950 Duraspeed, Extended Coverage . . . With Q45 Deflector, Sec. 5, AS/17-AS/18, Jan. 31, 1979, 2 pp.
Grinnell Corporation, Datasheet, Extended Coverage Horizontal Sidewall Sprinklers, Models F950,/Q-48 and 1F950/Q48 . . . Orifice, TD548, Sep. 1987, 4 pp.
Grinnell Corporation, Datasheet, Horizontal Sidewall and Recessed HSW Sprinklers, Universal Model A, QR-EC and EC, 3 & 5 mm Bulb Type . . . 3/4" NPT**, TD547, May 1996, 8 pp.
Grinnell Corporation, Datasheet, Horizontal Sidewall and Recessed HSW Sprinklers, Universal Model A, QR-EC and EC, 3 & 5 mm Bulb Type . . . 1/2" NPT**, TD545, May 1996, 8 pp.
Grinnell Corporation, Datasheet, Spr., Nozzles and Accessories, Section 4, Grinnell Sidewall Spr. Model F950,Q34, Hor. Extended Coverage, Bulletin No. 219, Aug. 1975, 2 pp.
Grinnell Corporation, Datasheet, Spr., Nozzles and Accessories, Section 4, Grinnell Sidewall Spr. Model F950,Q33, Hor. Extended Coverage, Bulletin No. 220, Aug. 1975, 2 pp.
Grinnell Corporation, Datasheet, Dry Horizontal Sidewall Sprinklers, Models F960,/Q-46 Designer, 1/2" Orifice, TD555, Nov. 1992, 4 pp.
Grinnell Corporation, Datasheet, Horizontal Sidewall Sprinkler, Model F950/Q46 Solder Type 1/2" Orifice, TD536, 1997, 2 pp.
Grinnell Corporation, Datasheet, Horizontal Sidewall and Recessed HSW Sprinklers, Model A/Q-71, Standard Response, 5 mm Bulb Type . . . 1/2" NPT**, TD535, May 1996, 3 pp.
Grinnell Corporation, Datasheet, Horizontal Sidewall and Recessed HSW Spr., Universal Model A/Q-71, Standard Response, 5 mm Bulb Type . . . 1/2" NPT**, TD535M, May 1996, 5 pp.
Grinnell Corporation, Datasheet, Horizontal Sidewall and Recessed HSW Sprinklers, Model A/Q-71, Standard Response, 3 mm Bulb Type . . . 1/2" NPT**, TD534, Dec. 1996, 5 pp.
Grinnell Corporation, Datasheet, Automatic Sprinklers Model F950 Duraspeed, Horizontal Sidewall With Q-31 Deflector, 1/2" Orifice, Sec. 5 AS/11-AS/12, Jan. 31, 1979, 2 pp.
Central Sprinkler Corporation, Datasheet, 8-87 Sidewall Sprinkler H, Horizontal Sidewall Automatic Sprinkler, 1987, 4 pp.
Central Sprinkler Corporation, Datasheet, 8-87 Sidewall Sprinkler HF 17/32 (16' x 20' max) Extended Coverage Horizontal Sidewall Automatic Sprinkler, 1987, 4 pp.
Central Sprinkler Corporation, Datasheet, 8-87 Sidewall Sprinkler HF 17/32 (16' x 24' max) Extended Coverage Horizontal Sidewall Automatic Sprinkler, 1987, 4 pp.
Central Sprinkler Corporation, Model "H-1" Dry Horizontal Sidewall Sprinkler, Bulletin Hors-H-1, Rev. No. 4, 1986, 2 pp.
Central Sprinkler Corporation, Model "H-1" Adjustable Dry Horizontal Sidewall Sprinkler, Bulletin Hors-H-1-Adj, Rev. No. 4, 1986, 2 pp.
International Searching Authority, International Search Report and Written Opinion issued in International Application No. PCT/US2013/020233, Nov. 13, 2013, 14 pages.
U.S. Appl. No. 61/584,641, filed Jan. 9, 2012.

* cited by examiner

FIRE PROTECTION DEVICE

PRIORITY DATA & INCORPORATION BY REFERENCE

This application is a continuation application under 35 U.S.C. §120 of International Application No. PCT/US2013/020233 filed Jan. 4, 2013, which claims the benefit of priority to U.S. Provisional Patent Application No. 61/584,641, filed Jan. 9, 2012, each of which is incorporated by reference in its entirety.

TECHNICAL FIELD

The invention relates generally to a fire protection device for providing a uniform distribution of fire fighting fluid, e.g., water, in a horizontal area located below and distal of the device. More specifically, the invention is directed to a fire sprinkler device for horizontal mounting to provide a distribution of fire fighting fluid, e.g., water, in horizontal area located below and distal of the device.

SUMMARY OF THE INVENTION

Preferred embodiments of a subject fire protection device include a structure and preferred installation orientation to substantially uniformly distribute a fire fighting fluid, e.g., water, in a horizontal area located below and distal of the device. In one preferred embodiment, a fire protection device includes a frame having a body with an inlet and an outlet disposed spaced along a longitudinal axis to define a passageway with a nominal K-factor of 16.8 or greater. The body has a proximal end for coupling the fire protection device to a fluid supply line and a distal end opposite the proximal end. The frame further preferably includes a pair of arms disposed in a first plane generally parallel to the longitudinal axis and coupled to the distal end of the body.

The preferred fire protection device also includes a deflector assembly coupled to the arms. The preferred deflector assembly has a generally planar face portion distally spaced from the outlet of the body and substantially orthogonal to the longitudinal axis, the face portion further preferably includes two openings disposed on opposing sides of a second plane perpendicular to and intersecting the first plane along the longitudinal axis. A canopy portion is preferably supported on a first side of the first plane and spaced from a first perimeter section of the face portion disposed on the first side of the first plane. The deflector assembly further preferably includes a plurality of tines extending along a second perimeter section of the face portion disposed on a second side of the first plane opposite the first side. Each of the tines having an outer edge preferably defining an arc length of a common circle having a center aligned along the longitudinal axis.

In one preferred embodiment of the deflector assembly, each of the two openings of the generally planar face portion comprises a generally triangular flow aperture. The triangular flow aperture is preferably defined by a rectangular shaped portion disposed to one side of the first plane and a triangular shaped portion disposed to the other side of the first plane, the rectangular portion defines a length of elongation, a side of the triangle extending in the direction of the elongation for a distance that is less than the length of elongation.

In another particular preferred embodiment of the deflector assembly, the plurality of tines includes a planar portion angled with respect to the generally planar face portion to define an included angle angled with respect to the generally planar face portion, the included angle ranging between 15° and 20°. The preferred deflector assembly is symmetrical about the second plane, the plurality of tines are radially spaced apart to define a plurality of slots symmetrically disposed about the second plane, the plurality of slots including a central slot bisected by the second plane. Each of the preferred slots includes an opening entrance region and a closed end region with a transition region between the opening entrance and closed end regions, each region defining a slot width region length, the regions further defining a slot length measured from the entrance region at the outer edge to a portion of the closed end region closest to the longitudinal axis, the length of the entrance region defining a region length-to-slot length ratio, the central slot having the greatest region length-to-slot length ratio.

In one aspect of the preferred fire protection device when installed in a horizontal installation, the deflector assembly distributes a substantially uniform density of water ranging between 0.1 gpm/ft$^2$ to 0.4 gpm/ft$^2$ in each square foot of a rectangular area located approximately eighteen feet below and extending distally of the deflector assembly, the rectangular area having a first zone and a second zone, the first zone having a length of three feet extending distally of the deflector assembly, the second zone having a length of twenty-two feet extending distally of the first zone, the width of the first and second zones being equal, wherein the density range in the first zone is 0.3 to 0.4 gpm/ft$^2$ and the density range in the second zone is 0.15 to 0.3 gpm/ft$^2$.

BRIEF DESCRIPTIONS OF THE DRAWINGS

The accompanying drawings, which are incorporated herein and constitute part of this specification, illustrate exemplary embodiments of the invention, and, together with the general description given above and the detailed description given below, serve to explain the features of the invention.

DETAILED DESCRIPTION OF THE PREFERRED EMBODIMENTS

Figure 1:
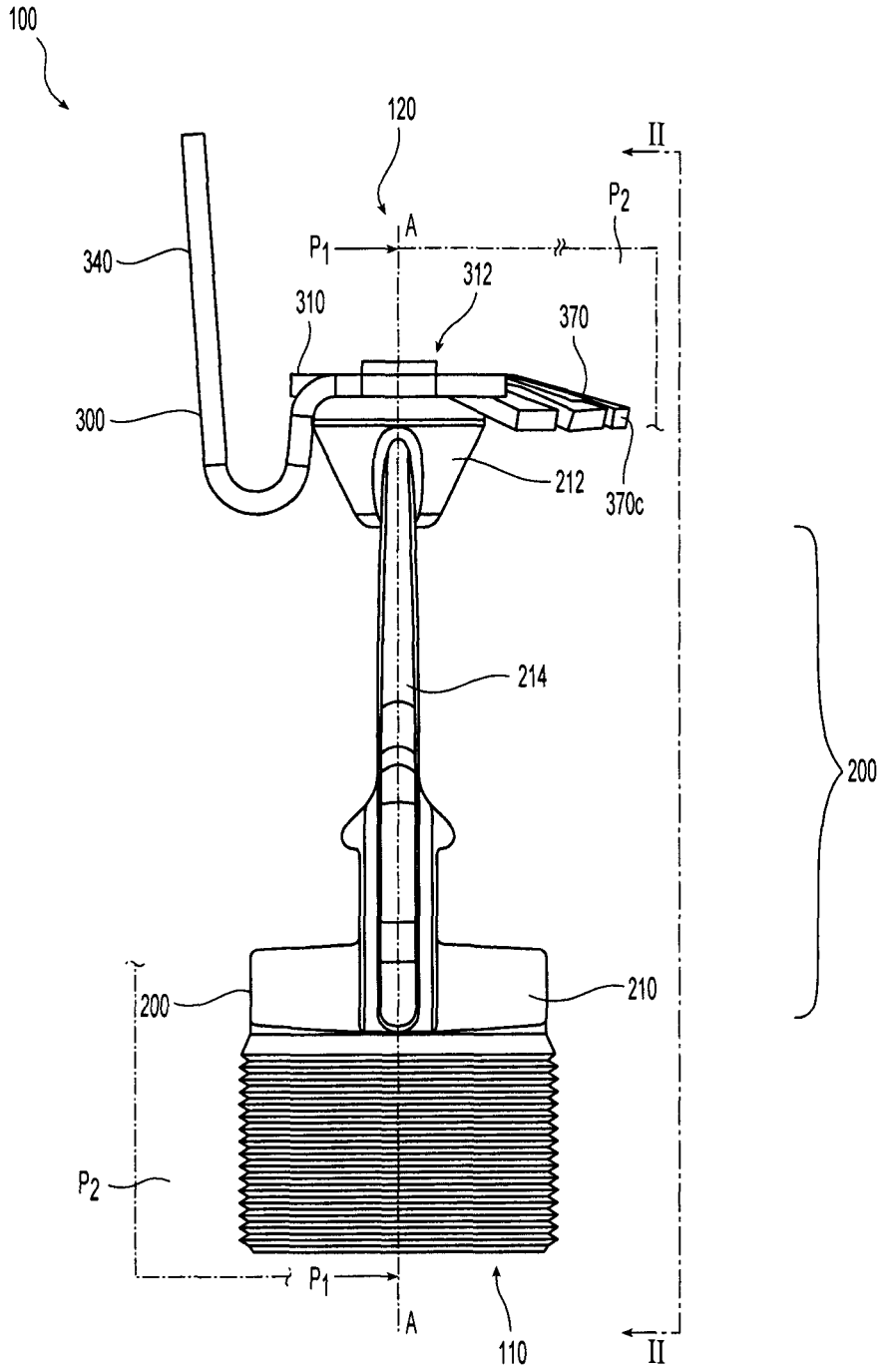
FIG. 1 is a side view of a preferred embodiment of a fire protection device.
Figure 1A:
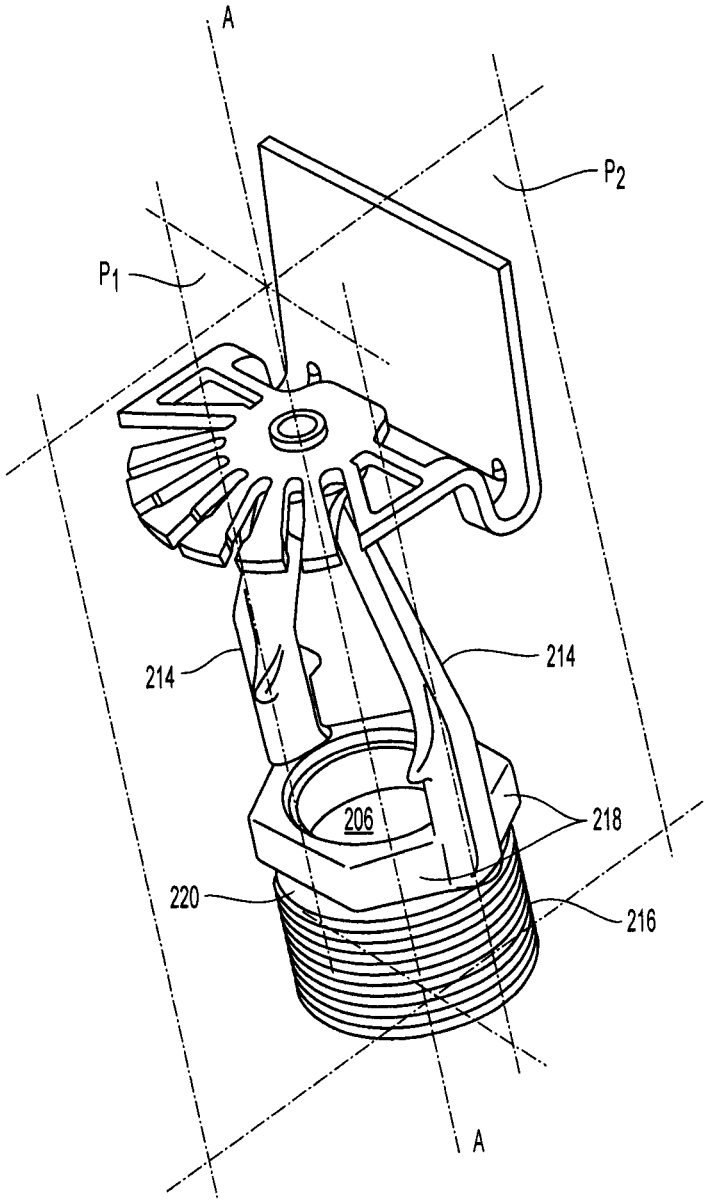
FIG. 1A is a side perspective view of a preferred embodiment of a fire protection device.
Figure 2:
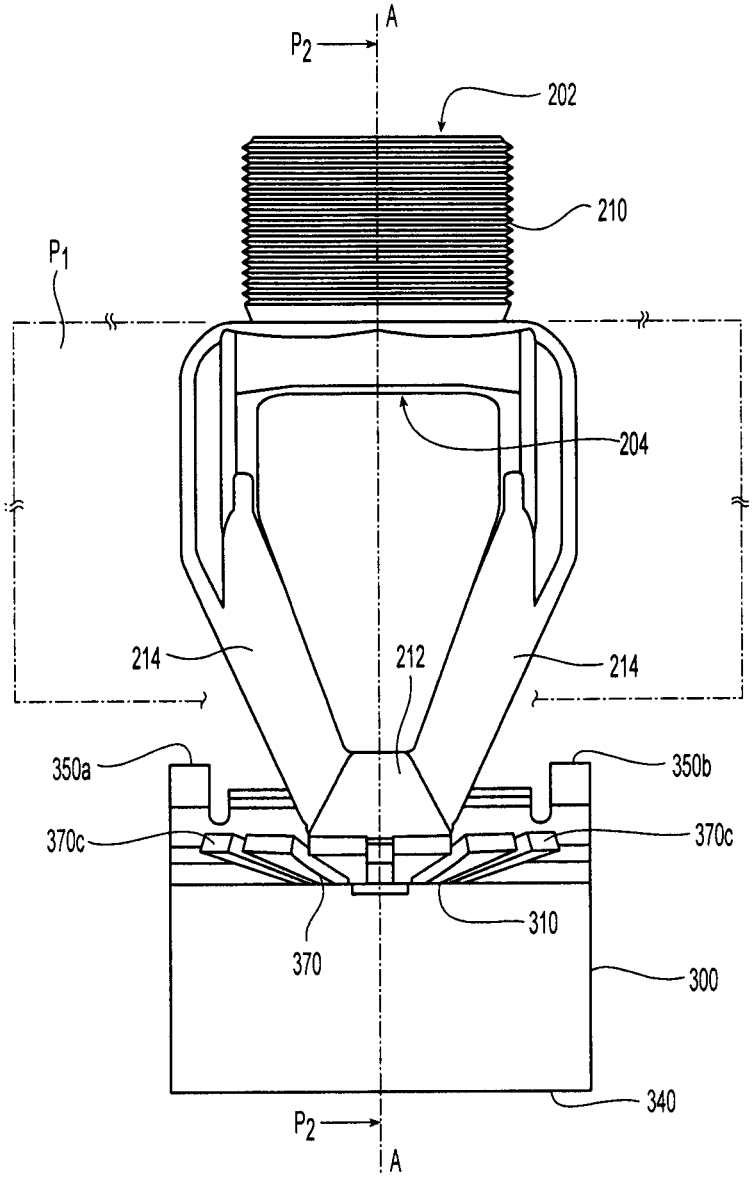
FIG. 2 is a side view of a preferred embodiment of the fire protection device along line II-II in FIG. 1.

Referring to FIG. 1, FIGS. 1A and 2, a preferred embodiment of the fire protection device 100 is shown. The fire protection device 100 is preferably mounted as a fire protection device oriented so as to distribute water over the area to be protected. The fire protection device 100 has a proximal end 110 and a distal end 120 extending along a longitudinal axis A-A. The longitudinal axis A-A is preferably the central axis of the fire protection device 100. The fire protection device 100, preferably includes a frame 200 and a deflector assembly 300. The frame 200 preferably includes a body 210 with an inlet 202, outlet 204 and a passageway 206 therebetween to define a nominal K-factor for a suitable application. In a preferred embodiment, the passageway defines a nominal K-factor of 16.8 or greater, and in particular, a nominal K-factor of 25. As used herein, the nominal K-factor is defined as a constant representing the sprinkler discharge coefficient, that is quantified by the flow of fluid in gallons per minute (GPM) from the sprinkler outlet divided by the square root of the pressure of the flow of fluid fed into the inlet of the sprinkler passageway in pounds per square inch (PSI). The nominal K-factor is expressed as $GPM/(PSI)^{1/2}$. Industry accepted standards, such as for example, the National Fire Protection Association (NFPA) standard entitled, "NFPA 13: Standards for the Installation of Sprinkler Systems" (2013 ed.) ("NFPA 13") provides for a rated or nominal K-factor or rated discharge coefficient of a sprinkler as a mean value over a K-factor range. For example, for a K-factor greater than 14, the following nominal K-factors are provided (with the K-factor range shown in parenthesis): (i) 16.8 (16.0-17.6) $GPM/(PSI)^{1/2}$; (ii) 19.6 (18.6-20.6) $GPM/(PSI)^{1/2}$; (iii) 22.4 (21.3-23.5) $GPM/(PSI)^{1/2}$; (iv) 25.2 (23.9-26.5) $GPM/(PSI)^{1/2}$; (v) 28.0 (26.6-29.4) $GPM/(PSI)^{1/2}$. The preferred device 100 is configured to operate with a supply of fluid at a preferred operating discharge pressure sufficient to provide a distribution of fluid to effectively address a fire event. Preferably, the operating pressure ranges from about fifteen pounds per square inch to about sixty pounds per square inch (15-60 psi.), preferably ranging from about fifteen pounds per square inch to about forty-five pounds per square inch (15-45 psi.), and is more preferably about sixteen pounds per square inch (16 psi.) so as to provide a preferred flow rate of approximately 100 gallons per minute (100 gpm.).

Referring to FIGS. 1 and 2, the body 210 preferably includes a mount 212 spaced from the body and disposed on the longitudinal axis by a pair of frame arms 214. The pair of arms are preferably spaced about the body 210 and disposed in a plane P1 preferably parallel to and more preferably including the longitudinal axis A-A. To connect the fire protection device 100 to the fire protection system piping, the body 210 can include an outer surface provided with a threaded portion 216 and multiple-flat portion 218 connected by a transition portion 220. The threaded portion 216 preferably includes threads of about 1 inch National-Pipe-Thread ("NPT") and can include threads greater than or less than 1 inch NPT; or other suitable threading configuration. The flat portion 218 can include a surface for tool engagement, for example, a four-sided flat for engagement with an installation tool such as an adjustable wrench.

Figure 3:
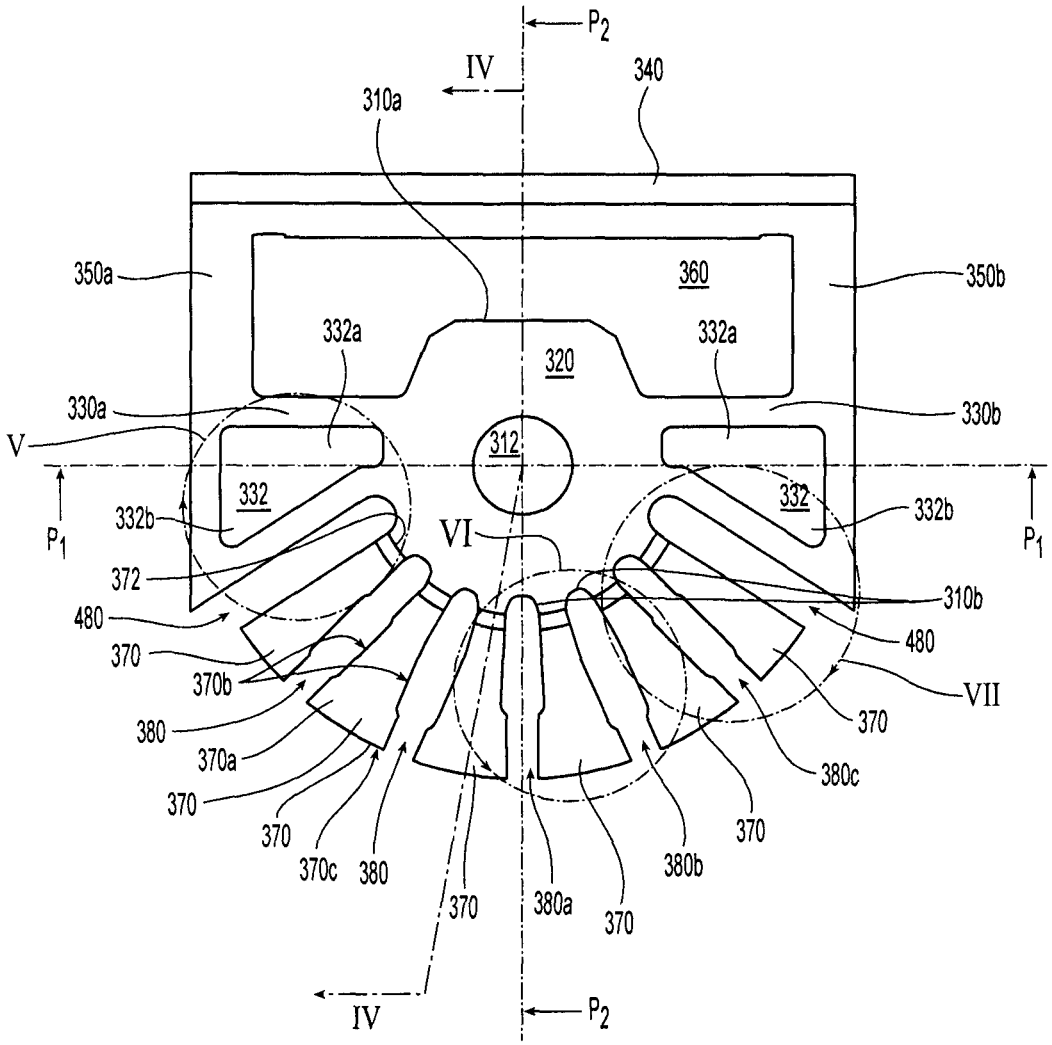
FIG. 3 is a front view of the preferred embodiment of the fire protection device of FIG. 1.

Referring to FIG. 1 and FIG. 3, the deflector assembly 300 includes a generally planar face portion 310 substantially perpendicular to the longitudinal axis A-A. The generally planar face portion 310 preferably defines a preferably central through bore 312 for engagement with the mount 212 to secure the deflector assembly 300 to the frame 200 of the fire protection device assembly. The generally planar face portion 310 can be secured to the mount 212 by way of an interference fit such as, for example, by way of a flared or crimped portion of mount 212. Alternatively, the generally planar face portion 310 can be fastened to the mount 212 by a rivet or other mechanical fastening device. The generally planar face portion 310 preferably includes a perimeter with a first section 310*a* disposed to one side of the plane P1 and a second section 310*b* on the opposite side of the plane P1 extends perpendicular to the longitudinal axis A-A.

The generally planar face portion 310 is preferably defined by a central portion 320, and a pair of side portions 330*a*, 330*b* disposed about the central portion 320. The central portion 320 preferably includes the bore 312 and the first and second sections 310*a*, 310*b* of the perimeter of the generally planar face portion 310. Each of the side portions 330*a*, 330*b* preferably include a flow aperture 332 defined by a preferably generally triangular shaped perimeter 334*a*, 334*b*, 334*c*, as shown for example in FIG. 5. Alternatively, the apertures 332 may be defined by another geometry such as, for example, circular, oval, rectangular or square in shape. One of the perimeters 334*a* that defines the apertures 332 preferably further defines lateral edges of the generally planar face portion 310.

Figure 5:
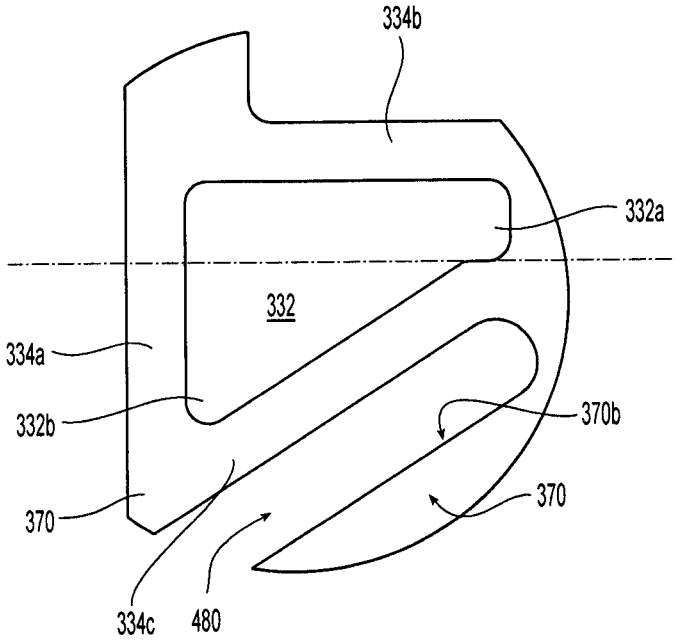
FIG. 5 is a detailed view included in the area V of the deflector assembly in FIG. 3 prior to bending the tines as seen in FIG. 4.

The preferably triangular-shaped aperture 332 is preferably formed by a rectangular portion 332*a*, and a triangular portion 332*b*. More specifically, the deflector assembly 300 is preferably secured to the frame 200 such that the plane P1 intersects the apertures 332 such that the rectangular portion 332*a* is disposed to one side of the plane P1 and the triangular portion 332*b* is disposed on the opposite side of the plane P1 as seen in FIG. 3. With reference to FIG. 5, the rectangular portion 332*a* is preferably elongated in the lateral direction to define the length of the rectangular portion. In one preferred embodiment, the long side of the rectangle is about 0.5 inch and the short side of the rectangle is preferably greater than 0.1 inch and is more preferably about ⅛ inch. The triangular portion 332*b* has a side extending parallel to the direction of elongation for a distance that is preferably less than the length of the rectangular portion 332*a*. In the preferred embodiment, the lateral edge 334*a* is preferably less than about 0.5 inch and more preferably about 0.4 inch, with the lateral edge 334*a* and perimeter edge 334*c* defining a preferred included angle of about 60° and more preferably about 57°.

Figure 4:
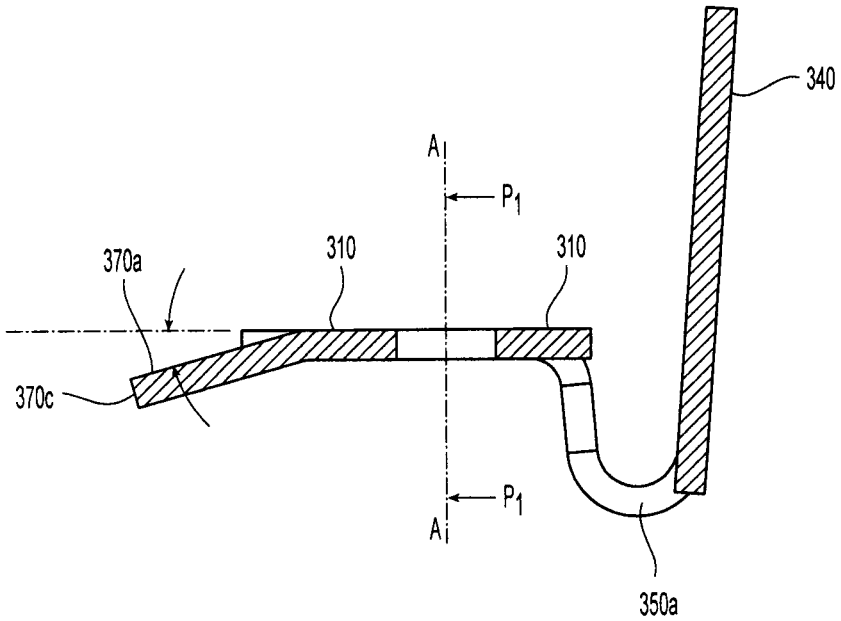
FIG. 4 is a cross-sectional view of the deflector assembly for use in the device of FIG. 1.

Referring to FIGS. 1, 3 and 4, the deflector assembly 300 further includes a canopy portion 340 that extends longitudinally. Canopy portion 340 of the preferred embodiment is at least substantially or generally planar and is supported from the face portion 310, oriented parallel to or slightly angled with respect to a plane parallel to the plane P1 such as, for example, to define an angle of less than ten degrees and more preferably define an included angle of less than five degrees and more preferably about 4°. The preferred canopy portion 340 is at least essentially planar and is located adjoining but spaced from the first section 310 of the perimeter of the generally planar face portion 310 and is supported by a pair of preferably curvilinear supports 350*a*, 350*b* of the deflector assembly 300 disposed preferably equidistantly about the central bore 312. The curvilinear portion 350*a* in one preferred embodiment is substantially U-shaped in profile, as seen for example in FIG. 4, with a preferred radius of curvature of about ⅛ inch. Moreover, the curvilinear supports 350*a*, 350*b* locate the planar face portion 310 relative to the distal edge of the canopy portion 340 and more preferably locates the face portion 310 at a distance of about one inch proximally of the distal edge of the canopy 340.

Referring to FIG. 3, the canopy portion 340, the supports 350*a*, 350*b* and the generally planar face portion 310 define therebetween a flow opening 360 of the deflector assembly 300. Further, in addition or alternatively, wherein the flow opening 360 defines an opening width extending in a direction from one support to the other support with the pair of supports each having a curvilinear portion 350*a*, 350*b* closest to the opening of the body; and the canopy having a distal linear edge furthest from the opening, the linear distance between the curvilinear portion of the supports and the linear edge of the canopy is preferably approximately equal to the opening width.

The deflector assembly 300 further preferably includes a plurality of tines 370 disposed to one side of the plane P1 opposite the canopy portion 340. Preferably, the plurality of tines 370 extend from the second section 310*b* of the perimeter of the generally planar face portion 310. Each of the tines 370 preferably has a planar portion 370*a*, a pair of side edges 370*b*, and an outer edge 370*c*. Preferably the side edges 370*a*, 370*b* are configured differently such that the tine 370 is asymmetric about a radial line extending from the longitudinal axis and the bisecting the tine 370. The outer edge 370*c* of each of the tines 370 is preferably disposed on a perimeter of a common circle C such that each outer edge 370*c* defines an arc length of the common circle C. For the preferred embodiment, the plurality of tines defines at least two different arc lengths. In addition or alternatively, where the canopy defines a canopy width extending in a direction from one support to the other support 350*a*, 350*b*, the common circle C has a preferred diameter approximately equal to the canopy width with its center aligned with or located along the longitudinal axis A-A. Referring to FIG. 4, each of the outer edges 370*c* of each of the tines 370 is preferably located between the generally planar face portion 310 and the outlet 204 of the body 210 so that the planar portions 370*a* extend at an angle with respect to the generally planar face portion 310. More preferably, each of the tines 370 are angled with respect to the planar face portion 310 at a bend line 372 which is preferably located at a radius of about one-half inch from the longitudinal axis A-A. With reference to FIG. 4, the planar portions 370*a* of the tines 370 are preferably angled toward the longitudinal axis A-A so as to define an included angle ranging between about 10° and 30°, preferably between 10° and 20° and more preferably between about 15° and 20°, and is even more preferably 16° with respect to the generally planar face portion 310. Alternatively, the planar portions 370*a* may be aligned with the generally planar face portion 310 provided the deflector distribute water with one or more aspects of the water distribution described herein.

The plurality of tines 370 are preferably radially spaced apart to define a plurality of slots 380 therebetween as shown, for example, in FIG. 3. The deflector assembly 300 is preferably symmetrical about a second plane P2 disposed perpendicular to the first plane. In the preferred embodiments, the plurality of slots 380 are symmetrically disposed about the second plane that includes axis B-B so as to define a central slot 380*a* bisected by the second plane P2. Preferably symmetrically disposed about the central slot are one or more radially spaced slots, 380*b*, 380*c* . . . 380*n*. Thus, where for example, the number of tines in the assembly is x and x is an even number, then the number of slots is x−1. For the preferred deflector assembly 300 of FIG. 3, there are preferably six tines 370 such that x=6. However, alternate embodiments may have fewer or more tines provided that the tines distribute water with one or more aspects of the water distribution described herein.

Figure 6:
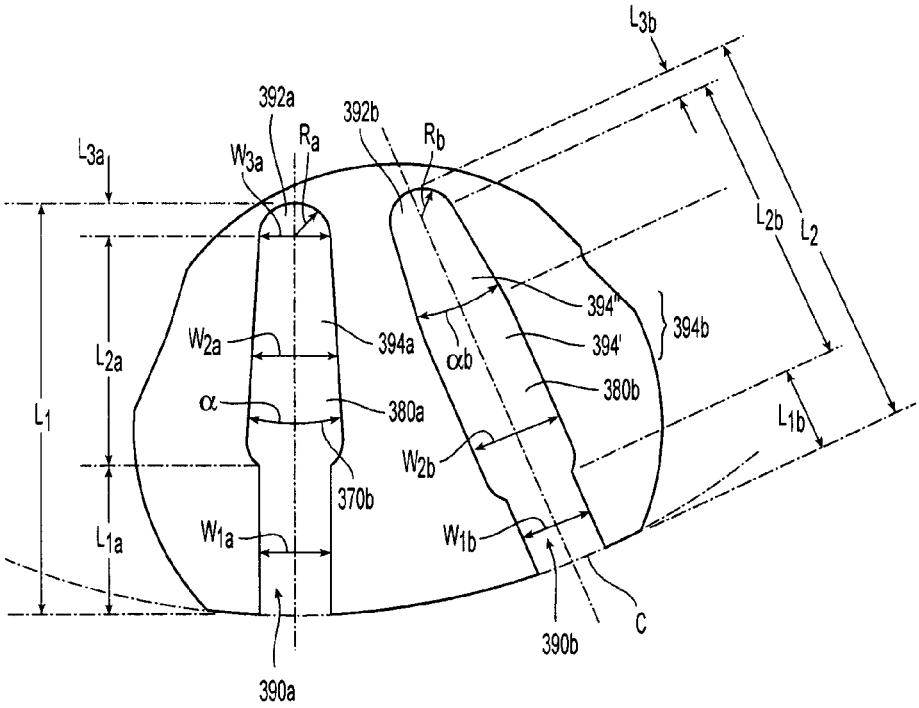
FIG. 6 is a detailed view included in the area VI of the deflector assembly in FIG. 3 prior to bending the tines as seen in FIG. 4.

Each of the plurality of the slots 380 extend from an opening entrance region 390 which initiates at the outer edges 370*c* of the tines to a radially innermost closed end region 392. Formed between the opening entrance region 390 and the closed end region 392 is a transition region 394 of the slot, which is of a preferably variable width along its radial length. Moreover, the opposed side edges 370*a*, 370*b* of radially adjacent and spaced tines 370 are configured such that the slots 380 are preferably symmetrical about a radial line extending from the longitudinal axis A-A and bisecting the slot 380. The central slot 380*a* is an illustrative example showing the regions of a slot 380. Referring to FIG. 3 and FIG. 6, the central slot 380*a* includes an opening entrance region 390*a*, a closed end region 392*a* and a transition region 394*a* between the opening entrance and closed end regions.

Each slot 380 is defined by a slot length L which extends preferably parallel to a line bisecting the slot from the opening entrance region 390 at the outer edge 370*c* of the adjacent tines to a portion of the close end region 392 radially closest to the central through bore 312. Each slot 380 is further defined by a slot width W which extends perpendicular to the slot bisecting line and can vary from region to region in the slot or additionally vary within a particular region of the slot. Referring again to the central slot 380*a* in FIG. 6, the opening region 390*a* has a preferred constant width W1*a*, which extends over a length of the opening region L1*a* from the slot opening at the outer edge 370*a* to the start of the transition region 394*a*. The start of the transition region 394*a* is preferably defined by the change in slot width W1*a* from the opening region 390*a* to a second different slot width W2*a*. More preferably, the slot width W2*a* of the transition region 394*a* tapers narrowly in the direction of the closed end region 392*a* at a preferably constant rate over the length L2*a* of the transition region 394*a*. Accordingly, the slot width of the transition region 394*a* can be characterized by the included angle α between the tine side edges 370*b* of the radially adjacent tines 370 defining the slot 380*a*. The closed end region 392*a* is preferably defined by a radius of curvature R which extends from a center of curvature P disposed along the bisecting line of the slot 380*a*. Accordingly, the junction of the transition region 394*a* to the closed end region 392*a* is preferably defined where second width W2*a* of the transition region 394*a* is equal to two times the radius of curvature R. Thus, the maximum slot width W3*a* of the closed end region is preferably defined by two times the radius of curvature R. Alternatively or in addition to, the slot width W3*a* of the closed end region 392*a* preferably narrows in the radial direction towards the portion of the closed end region 392*a* closest the central bore 312. Each of the plurality of slots can be characterized by the ratio of the length L1, L2, L3 of any slot region 390, 392, 394 to the overall length L of the slot 380, i.e., region length-to-slot length ratio. Accordingly, the preferred dimensions of the embodiments described herein can be varied while substantially maintaining the ratio relationships described herein to provide or maintain the desired water distribution performance also described herein.

Accordingly a combination of the previously described slot features can be used to form the embodiments of the deflector assembly to carry out the water distribution described herein. More particularly, for the preferred deflector assembly 300, the central slot 380 defines a slot length L1 ranging from about 0.575 inch to about 0.6 and more preferably about 0.58 inch with an opening entrance region 390*a* having a preferably constant width W1*a* of about 0.1 inch and a region length L1*a* of about 0.2 inch so as to define a preferred length-to-slot length ratio L1*a*:L1 of about 0.3. For the preferred central slot 380*a*, the transition region 394*a* is defined by an included angle α of about 7° between the side edges 370*b* forming the slot 380*a*. The length L3*a* of closed end region 392*a* is preferably defined by and equivalent to its radius of curvature Ra being about 0.05 inch with the maximum width W3*a* of the central slot being twice the radius of curvature.

The preferred deflector assembly 300 includes a first pair of preferably symmetric slots 380*b* laterally disposed about the central slot 360*a*. The central slot 380 and each of the first slots 380*b* define a preferred included angle therebetween ranging from about 20° to about 25° and is preferably about 23°. Each of the first pair of slots 380*b* defines a slot length L2 ranging between about 0.575 inch to about 0.6 inch and is more preferably about 0.57 inch with an opening entrance region 390*b* having a preferably constant width W1*b* of about 0.1 inch and a region length L1*b* of about 0.1 inch so as to define a preferred length-to-slot length ratio, L1*b*:L2 of about 0.2. For the preferred first lateral slot 380*b*, the transition region 394*b* is preferably defined by a first portion 394*b*' having a constant slot width W2*b* of greater than 0.1 inch, for example, about 0.15 inch, and more preferably about 0.13 inch; and a second region 394*b*" having an included angle αb of about 14° between the side edges 370*b* forming the slot 380*b*. The length L3*b* of closed end region 392*b* is preferably defined by and equivalent to its radius of curvature Rb ranging from about 0.045 inch to 0.05 inch with the maximum width W3*b* of the central slot being twice the radius of curvature. Preferably, the radius of curvature Rb is less than that of the central slot.

Figure 7:
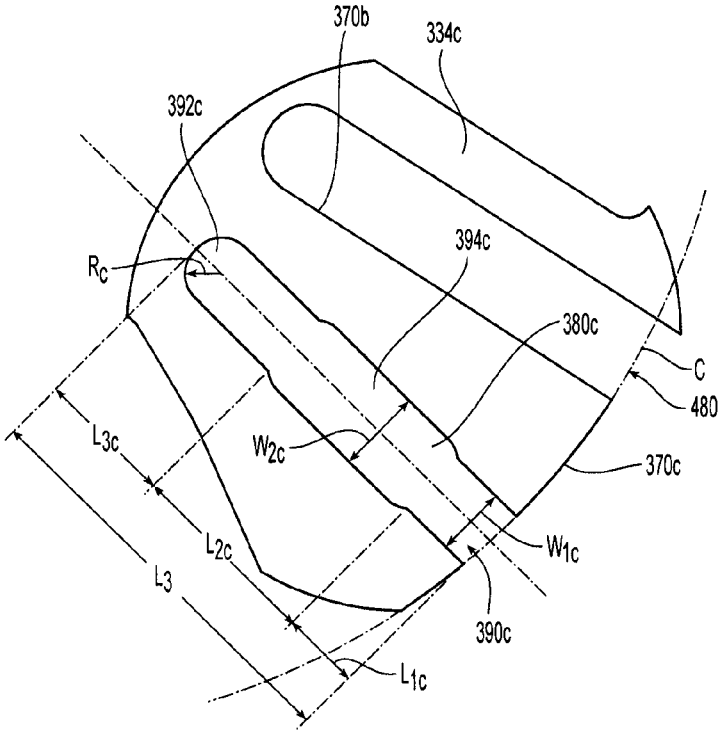
FIG. 7 is a detailed view included in the area VII of the deflector assembly in FIG. 3 prior to bending the tines as seen in FIG. 4.

Referring to FIG. 3 and FIG. 7, the preferred deflector assembly 300 includes a second pair of preferably symmetric slots 380*c* laterally disposed about the central slot 380*a* and more preferably laterally disposed about the first pair of slots 380*b*. Preferably, each of the second slots 380*c* are radially spaced at an angle of about 45° with respect to the central slot 380*a*. Each of the second pair of slots 380*c* defines a slot length L3 ranging from about 0.575 inch to about 0.6 inch and is more preferably about 0.58 inch with an opening entrance region 390*c* having a preferably constant width W1*c* of about 0.1 inch and a region length L1*c* of about 0.1 inch so as to define a preferred length-to-slot length ratio, L1*c*:L3 of about 0.2. Accordingly, for the preferred deflector assembly, the entrance region of the central slot 380*a* defines the greatest length-to-slot ratio of the plurality of the slots 380. For the preferred second lateral slot 380*c*, the transition region 394*c* is preferably defined by a constant slot width W2*c* of greater than 0.1 inch, for example, about 0.15 inch, and more preferably about 0.13 inch; and a length L2*c* ranging from about 0.20 inch to about 0.25 inch and more preferably 0.22 inch. The closed end region 392*b* is preferably defined by its radius of curvature Rc being about 0.05 inch and its length L3*c* of about 0.25 inch. Moreover, the adjacent tines 370 disposed laterally outside of and defining the second pair of symmetrical slots 680*c* include a side edge 370*b* that is spaced from and preferably extends parallel to the longest edge 334*c* of the triangular perimeter to the aperture 332.

The laterally outer tine 370 of each of the second slots 380*c* is spaced from the perimeter 334*c* of the triangular opening 332 to define an opening 480 which extends radially in a direction toward the bore 312. As seen in the view of the deflector assembly in FIG. 3, and the detailed view of FIG. 5, the laterally outer tine 370 of the second slot 380*c* and the perimeter 334*c* of the triangular opening preferably define a constant width therebetween along the radial length of the opening 480. Moreover, the perimeter 334*c* preferably extends radially further from the bore 312 as compared to the tine 370. In the preferred embodiment, the laterally outer tine 370 of the second slot 380*c* is preferably angled relative to the generally planar face portion in manner as previously described; and the perimeter 334*c* of the triangular opening is in the same plane as the generally planar portion. Accordingly, the side edge 370*b* of tine 370 defining the opening 480 preferably has a variable axial distance from the outlet 204 of the frame 200; and the edge of the perimeter 334*c* preferably defines a constant axial distance from the outlet 204.

The fire protection device 100 is configured to distribute water such that a rectangular area in a horizontal plane that is located approximately eighteen feet below the sprinkler and distal to the deflector of the fire protection device receives a substantially even distribution of water. That is, the density of the water distributed in gallons per minute per square foot (gpm/ft$^2$) is relatively constant over the entire area. The relative constant distribution of water provides for a fire protection device that can address a fire located in an area to be protected, e.g. the rectangular area beneath and distal the deflector. In a preferred embodiment of the fire protection device, the deflector is configured to distribute the water so that each square foot of area receives between 0.1 and 0.40 gallons per minute. More particularly, the deflector distributes the water in a manner such that the rectangular area is provided with at least two zones of density distribution. Preferably, a first zone of a selected number of feet extending away from the fire protection device is provided with a first range of density, and a second zone ending from the first zone for a greater distance than the first zone is provided with a second range of density. In a preferred application, the first and second zones have the same width of preferably about 16 feet. The length of the first preferred zone is approximately three feet and the second zone is approximately 22 feet. The density range in the first zone is 0.3 to 0.4 gpm/ft$^2$ and the density range in the second zone is 0.15 to 0.3 gpm/ft$^2$. In a further preferred embodiment, the density in the first zones is thirty percent greater than the density in the second zone. For example, average density in gpm/ft$^2$ in the first zone is approximately 0.32 to 0.35 with a deviation of less than 0.02 gpm/ft$^2$ and average density in the second zone is 0.15 to 0.21 with a deviation of less than 0.03 gpm/ft$^2$. Thus, the rectangular area is provided with a substantially uniform density over the entire area and, in a preferred embodiment, the density is greatest closest to the fire protection device; however, the distribution is uniform over the entire area so that each portion of the area receives approximately the same rate of water. Alternatively or in addition to, the preferred fire protection and deflector assembly provide for a substantially uniform distribution in a rectangular area below and distal of the deflector assembly. In view of the average density provided in the second zone, the preferred device can provide for uniform density in a rectangular area having a width of about 16 feet with a length initiating from about five feet distal of the deflector assembly and extending about 22 feet. The uniform distribution of the device is believed to be advantageous, for example, in protection of a tunnel space and in particular for installation in a deluge system for protection of a tunnel space.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

The invention claimed is:

1. A fire protection device for horizontal mounting to provide distribution of fire fighting fluid comprising:

a frame including:

a body having an inlet and an outlet disposed spaced along a longitudinal axis to define a passageway with a nominal K-factor of 16.8 or greater, the body having a proximal end for coupling the fire protection device to a fluid supply line, the body having a distal end opposite the proximal end;

a pair of arms disposed in a first plane generally parallel to the longitudinal axis, the arms being coupled to the distal end of the body; and a deflector assembly coupled to the arms, the deflector assembly including:

a generally planar face portion distally spaced from the outlet of the body and substantially orthogonal to the longitudinal axis, the face portion further including two openings disposed on opposing sides of a second plane perpendicular to and intersecting the first plane along the longitudinal axis;

a canopy portion supported on a first side of the first plane and spaced from a first perimeter section of the face portion disposed on the first side of the first plane; and a plurality of tines extending along a second perimeter section of the face portion disposed on a second side of the first plane opposite the first side, wherein the plurality of tines consists of each of the tines extending radially from the second perimeter section of the face portion and having an outer edge defining an arc length of a common circle having a center aligned along the longitudinal axis.

2. A fire protection device for horizontal mounting to provide distribution of fire fighting fluid comprising:

a frame including:

a body having an inlet and an outlet disposed spaced along a longitudinal axis to define a passageway with a nominal K-factor of 16.8 or greater, the body having a proximal end for coupling the fire protection device to a fluid supply line, the body having a distal end opposite the proximal end;

a pair of arms disposed in a first plane generally parallel to the longitudinal axis, the arms being coupled to the distal end of the body; and a deflector assembly coupled to the arms, the deflector assembly including:

a generally planar face portion distally spaced from the outlet of the body and substantially orthogonal to the longitudinal axis, the face portion further including two openings disposed on opposing sides of a second plane perpendicular to and intersecting the first plane along the longitudinal axis;

a canopy portion supported on a first side of the first plane and spaced from a first perimeter section of the face portion disposed on the first side of the first plane; and a plurality of tines extending radially from a second perimeter section of the face portion disposed on a second side of the first plane opposite the first side, each of the tines having an outer edge defining an arc length of a common circle having a center aligned along the longitudinal axis;

wherein each of the two openings comprise a generally triangular flow aperture defined by a rectangular shaped portion disposed to one side of the first plane and a triangular shaped portion disposed to the other side of the first plane, the rectangular portion defining a length of elongation, a side of the triangle extending in the direction of the elongation for a distance that is less than the length of elongation.

3. The fire protection device of claims 1 or 2, wherein the outer edges are longitudinally disposed between the outlet of the body and the generally planar face portion.

4. The fire protection device of claim 3, wherein each of the plurality of tines includes a planar portion angled with respect to the generally planar face portion to define an included angle angled with respect to the generally planar face portion, the included angle ranging between 15° and 20°.

5. The fire protection device of claims 1 or 2, wherein each of the plurality of tines is asymmetrical about a line extending radially from the longitudinal axis and bisecting the tine.

6. The fire protection device of claims 1 or 2, wherein the deflector assembly is symmetrical about the second plane, the plurality of tines being radially spaced apart to define a plurality of slots symmetrically disposed about the second plane, the plurality of slots including a central slot bisected by the second plane.

7. The fire protection device of claim 6, wherein the number of tines is x, x being an even number, and the number of slots is x−1.

8. The fire protection device of claim 7, wherein x=6.

9. A fire protection device for horizontal mounting to provide distribution of fire fighting fluid comprising:

a frame including:

a body having an inlet and an outlet disposed spaced along a longitudinal axis to define a passageway with a nominal K-factor of 16.8 or greater, the body having a proximal end for coupling the fire protection device to a fluid supply line, the body having a distal end opposite the proximal end;

a pair of arms disposed in a first plane generally parallel to the longitudinal axis, the arms being coupled to the distal end of the body; and a deflector assembly coupled to the arms, the deflector assembly including:

a generally planar face portion distally spaced from the outlet of the body and substantially orthogonal to the longitudinal axis, the face portion further including two openings disposed on opposing sides of a second plane perpendicular to and intersecting the first plane along the longitudinal axis;

a canopy portion supported on a first side of the first plane and spaced from a first perimeter section of the face portion disposed on the first side of the first plane; and a plurality of tines extending along a second perimeter section of the face portion disposed on a second side of the first plane opposite the first side, each of the tines having an outer edge defining an arc length of a common circle having a center aligned along the longitudinal axis;

wherein the deflector assembly is symmetrical about the second plane, the plurality of tines being radially spaced apart to define a plurality of slots symmetrically disposed about the second plane, the plurality of slots including a central slot bisected by the second plane; and wherein each of the slots includes an opening entrance region and a closed end region with a transition region between the opening entrance and closed end regions, each region defining a slot width region length, the regions further defining a slot length measured from the entrance region at the outer edge to a portion of the closed end region closest to the longitudinal axis, the length of the entrance region defining a region length-to-slot length ratio, the central slot having the greatest region length-to-slot length ratio.

10. The fire protection device of claim 9, wherein the entrance region of the central slot defines a region length-to-slot length ratio of about 0.3 inch and a constant slot width, the transition region of the central slot defining a slot width that tapers narrowly at a constant rate in the direction from the entrance region to the closed end region.

11. The fire protection device of claim 10, wherein the plurality of slots include a first pair of slots laterally disposed about the central slot, wherein the entrance region of each of the first pair of slots define a region length-to-slot length ratio of about 0.2 inch and a constant slot width, the transition region of each of the first pair of slots having a first portion and a second portion, the first portion defining a constant slot width, the second portion defining a slot width that tapers narrowly at a constant rate in the direction toward the closed end region.

12. The fire protection device of claim 1, wherein the plurality of slots include a second pair of slots laterally disposed about the first pair of slots, wherein the entrance region of each of the second pair of slots define a region length-to-slot length ratio of about 0.2 inch and a constant slot width, the transition region of each of the second pair of slots defining a constant slot width greater than the slot width of the entrance region, the closed end region of each of the second pair of slots defining a radius of curvature with a center of curvature located along a bisecting line of the slot, the length of the closed end region in each of the second pair of slots being greater than the radius of curvature.

13. The fire protection device of claim 12, wherein the closed end region of each of the central and first pair of slots are defined by a radius of curvature with a center of curvature located along a bisecting line of the slot, the length of each closed end region of each of the central and first pair of slots being equal to the radius of curvature.

14. The fire protection device of any one of claims 1, 2, or 9, wherein the outer edges of the plurality of tines define at least two different arc lengths along the common circle; and wherein further the slots each define an opening of equal width between the outer edges of the plurality of tines.

15. The fire protection device of any one of claims 1, 2, or 9, wherein the canopy defines a canopy width extending in a direction from one support to the other support, the common circle having a diameter approximately equal to the canopy width.

16. A fire protection device for horizontal mounting to provide distribution of fire fighting fluid comprising:

a frame including:

a body having an inlet and an outlet disposed spaced along a longitudinal axis to define a passageway with a nominal K-factor, the body having a proximal end for coupling the fire protection device to a fluid supply line, the body having a distal end opposite the proximal end;

a pair of arms defining a plane parallel to and intersecting the longitudinal axis, the arms being coupled to the distal end of the body; and a mount supported by the pair of frame arms distal the outlet and aligned with the longitudinal axis; and a deflector assembly coupled to the mount, the deflector assembly including:

a generally planar face portion distally spaced from the outlet of the body and substantially orthogonal to the longitudinal axis a canopy portion supported on a first side of the plane and spaced from a first perimeter section of the face portion disposed on the first side of the plane; and a plurality of tines extending along a second perimeter section of the face portion disposed on a second side of the plane opposite the first side, wherein the plurality of tines consists of each of the tines extending radially from the second perimeter section of the face portion and having an outer edge defining an arc length of a circle having a center aligned along the longitudinal axis.

17. The fire protection device of claim 16, wherein the face portion further includes two openings disposed on either side of a central axis and on opposing sides of a second plane that is perpendicular to and intersecting the plane of the frame arms along the longitudinal axis.

18. The fire protection device of claim 17, wherein each of the two openings comprise a generally triangular flow aperture defined by a rectangular shaped portion disposed to one side of the plane and a triangular shaped portion disposed to the other side of the plane, the rectangular portion defining a length of elongation, a side of the triangle extending in a direction of the elongation for a distance that is less than the length of elongation.

19. A fire protection device for horizontal mounting to provide distribution of fire fighting fluid comprising:

a flame including:

a body having an inlet and an outlet disposed spaced along a longitudinal axis to define a passageway with a nominal K-factor, the body having a proximal end for coupling the fire protection device to a fluid supply line, the body having a distal end opposite the proximal end;

a pair of arms disposed in a first plane generally parallel to and including the longitudinal axis, the arms being coupled to the distal end of the body; and a mount supported by the pair of frame arms distal the outlet and aligned with the longitudinal axis; and a deflector assembly including:

a generally planar face portion distally spaced from the outlet of the body and substantially orthogonal to the first plane, the generally planar face portion further including two flow apertures disposed on opposing sides of a second plane that intersects the longitudinal axis and is perpendicular to the first plane, each flow aperture being disposed on both sides of the first plane and having a generally triangular perimeter;

a canopy portion supported on one side of the first plane and spaced from the generally planar face portion; and a plurality of spaced apart tines extending along a peripheral edge of the generally planar face portion to define a plurality of slots, wherein the plurality of tines consists of each of the tines extending radially from the second perimeter section of the face portion and having an outer edge defining an are length of a common circle having a center aligned along the longitudinal axis.

20. The fire protection device of claim 19, wherein each of the generally triangular flow apertures define a rectangular shaped portion disposed to one side of the first plane and a triangular shaped portion disposed to the other side of the plane, the rectangular portion defining a length of elongation, a side of the triangle extending in a direction of the elongation for a distance that is less than the length of elongation.

21. The fire protection device of claim 19, wherein the deflector is symmetrical about the second plane, the plurality of slots being symmetrically disposed about the second plane and including a central slot bisected by the second plane.

22. The fire protection device of claim 19, wherein the number of tines is x, x being an even number, and the number of slots is x−1.

23. The fire protection device of claim 19, wherein the outer edges of the plurality of tines define at least two different are lengths along the common circle; and wherein further the slots each define an opening of equal width between the outer edges of the plurality of tines.

24. The fire protection device of claim 19, wherein the deflector assembly includes a pair of supports supporting the canopy, the canopy defining a canopy width extending in a direction from one support to the other support, the common circle having a diameter approximately equal to the canopy width.

25. The fire protection device of claim 24, wherein the canopy is spaced from the general planar face portion to define a flow opening having a width extending in a direction from one support to the other support, the pair of supports each having a curvilinear portion closest to the opening of the body, the canopy having a linear edge furthest from the opening, the linear distance between the curvilinear portion of the supports and the linear edge of the canopy being approximately equal to the opening width.

26. The fire protection device of claim 19, wherein each of the plurality of slots includes an opening entrance region and a closed end region with a transition region between the opening entrance and closed end regions, each region defining a slot width region length, the regions further defining a slot length measured from the entrance region at the outer edge to a portion of the closed end region closest to the longitudinal axis, the length of the entrance region defining a region length-to-slot length ratio, the central slot having the greatest region length-to-slot length ratio.

27. The fire protection device of any one of claims 1, 2, 9 or 16, wherein the deflector assembly distributes a density of water ranging between 0.1 gpm/ft$^2$ to 0.4 gpm/ft$^2$ in each square foot of a rectangular area located approximately eighteen feet below and extending distally of the deflector assembly, the rectangular area having a first zone and a second zone, the first zone having a length of three feet extending distally of the deflector assembly, the second zone having a length of twenty-two feet extending distally of the first zone, the width of the first and second zones being about sixteen feet, wherein a density range in the first zone is 0.3 to 0.4 gpm/ft$^2$ and the density range in the second zone is 0.15 to 0.3 gpm/ft$^2$.

28. The fire protection device of any one of claims 1, 2, or 9, wherein the deflector assembly distributes a density of water ranging between 0.1 gpm/ft$^2$ to 0.4 gpm/ft$^2$ in each square foot of a rectangular area located approximately eighteen feet below and disposed distally of the deflector assembly, the rectangular area having a width of about sixteen feet and a length initiating 5 feet distal of the deflector assembly and extending about 22 feet distally, wherein a density range in the rectangular area is 0.15 to 0.3 gpm/ft$^2$.

29. The fire protection device of claim 12, wherein each of the two openings comprising a generally triangular flow aperture and further comprising a radially extending opening disposed between one of the second pair of slots and one of the two openings disposed on opposing sides of the second plane, the radially extending opening being defined by a laterally outer tine of one of the second pair of slots and a perimeter of one of the two openings, the outer tine having a variable axial distance from the outlet of the body and the perimeter having a constant axial distance from the outlet.

30. The fire protection device of claim 19, wherein the deflector assembly distributes a density of water ranging between 0.1 gpm/ft to 0.4 gpm/ft$^2$ in each square foot of a rectangular area located approximately eighteen feet below and extending distally of the deflector assembly, the rectangular area having a first zone and a second zone, the first zone having a length of three feet extending distally of the deflector assembly, the second zone having a length of twenty-two feet extending distally of the first zone, the width of the first and second zones being about sixteen feet, wherein a density range in the first zone is 0.3 to 0.4 gpm/ft$^2$ and the density range in the second zone is 0.15 to 0.3 gpm/ft$^2$.

31. The fire protection device of claim 16 or 19, wherein the nominal K-factor comprises a nominal K-factor of 16.8 or greater.

32. The fire protection device of claim 31, wherein the nominal K-factor of 16.8 or greater comprises a nominal K-factor of 25.2.

* * * * *